United States Patent [19]

Tecl et al.

[11] Patent Number: 5,000,090

[45] Date of Patent: Mar. 19, 1991

[54] METHOD FOR THE CONTINUOUS PRINTING OF A PLANAR STRUCTURE

[75] Inventors: Bohuslav Tecl; Jürgen Knoke, both of Weinheim; Sepp Wagner, Gorxheimertal-Trösel; Erich Fahrbach, Weinheim, all of Fed. Rep. of Germany

[73] Assignee: Firma Carl Freudenberg, Weinheim/Bergstr., Fed. Rep. of Germany

[21] Appl. No.: 753,798

[22] Filed: Jul. 8, 1985

Related U.S. Application Data

[63] Continuation of Ser. No. 673,721, Nov. 21, 1984, abandoned, which is a continuation of Ser. No. 123,907, Feb. 22, 1980, abandoned.

[30] Foreign Application Priority Data

Apr. 11, 1979 [DE] Fed. Rep. of Germany ..... 2914617

[51] Int. Cl.[5] ..... B41F 15/00; B41F 9/00

[52] U.S. Cl. ..... 101/170; 101/129

[58] Field of Search ..... 101/179, 180, 129, 221, 101/222, 223, 153, 376, 375, 170

[56] References Cited

U.S. PATENT DOCUMENTS

| | | | |
|---|---|---|---|
| 1,656,170 | 1/1928 | Cooper | 101/220 X |
| 2,333,172 | 11/1943 | Grupe | 101/220 |
| 3,303,779 | 2/1967 | Giori | 101/179 |
| 3,672,299 | 6/1972 | Fulk | 101/220 |
| 3,903,794 | 9/1975 | Grupe | 101/376 |
| 4,103,615 | 8/1978 | Cruz et al. | 101/220 |

FOREIGN PATENT DOCUMENTS

| | | | |
|---|---|---|---|
| 1188996 | 9/1959 | France | 101/376 |
| 970301 | 9/1964 | United Kingdom | 101/120 |
| 2015929 | 9/1979 | United Kingdom | 101/220 |

*Primary Examiner*—J. Reed Fisher

*Attorney, Agent, or Firm*—Kenyon & Kenyon

[57] ABSTRACT

The present invention discloses a method and apparatus for reinforcing non-woven sheets by printing a cross-linkable binder on one surface by means of a relief or photogravure printing cylinder while simultaneously printing the opposite surface at corresponding positions with a thermally softenable adhesive applied by means of a screen printing cylinder.

5 Claims, No Drawings

METHOD FOR THE CONTINUOUS PRINTING OF A PLANAR STRUCTURE

This is a continuation of Ser. No. 673,721, filed Nov. 21, 1984, now abandoned, which is a continuation of Ser. No. 123,907, filed Feb. 22, 1980, now abandoned.

This invention relates to a method and apparatus for the continuous printing of a planar structure. More particularly, this invention relates to a method and apparatus for the continuous printing of a porous and flexible planar structure.

Heretofore, various techniques have been known for the printing of porous flexible planar structures such as traveling webs. For example, it is known from rotary printing to apply many materials such as pastes to the front and back sides of a planar structure in successive stages to obtain a printing of both sides. However, a practical application of such a method leads to difficulties if the patterns to be applied on the front and back side of the planar structure are to be completely congruent with each other. Also, a sequential application of printing pastes to the opposite sides can cause shrinkage and elongation influences to effect the accuracy of the placement of the pastes. Furthermore, rotary presses consisting of several printing stations lined up in tandem are very expensive with respect to procurement costs and space requirements.

Accordingly, it is an object of the invention to simultaneously print congruent patterns on the front and back sides of a porous flexible planar structure.

It is another object of the invention to provide a method for printing on both sides of a travelling planar structure simultaneously using machines which are relatively small and can be procured at relatively low cost.

Briefly, the invention provides a method and apparatus for the continuous printing of a flexible planar structure.

The method is comprised of the steps of printing a first paste on a surface zone of a front side of a flexible planar structure and of simultaneously printing a second paste to a backside of the structure on a surface zone directly opposite the surface zone on the front side. After printing, the structure is dried in any suitable conventional manner.

The method assures that the planar structure is wetted with the printing pastes on the two surfaces simultaneously and in directly opposite regions. The printing pastes can therefore exert no detrimental influence on the mechanical properties of the planar structure, as was often the case with the prior methods because shrinkage and elongation influences came into play. For this reason, the method allows a completely congruent application of possibly very finely detailed patterns on the upper and underside of flexible planar structures of any composition.

The method is extremely variable as far as the patterns obtainable and the application of the substances used are concerned. It is possible, for instance, to print the planar structure with a pattern only on one side or on both sides and, if printed on both sides, the two printing patterns can be correlated in a targeted manner. The pitch of the print patterns used on both sides may be identical in the lengthwise and crosswise direction or may be modified in the lengthwise and/or crosswise direction by a given factor. If this factor corresponds to a full-line multiple of the pitch of the coarser print pattern divided by the pitch of the finer patterns, a rigid mutual correlation of the two patterns is obtained. If the factor, however, corresponds to a not-full-line multiple of the pitch of the coarser print pattern divided by the pitch of the finer patterns, a continuously varying correlation of the pattern of the top side compared to the underside is obtained.

The method allows the top side and/or the underside of the planar structure to be printed either with a continuous layer or with certain regions of one side remaining completely unprinted.

The method also allows different pastes to be printed on the top side and the underside, for instance, a hydrophilically adjusted substance on the top side and a hydrophobically adjusted substance on the underside. Also, in conjunction with the possibility of printing one paste on at a greater pressure than the other, the mechanical and technological properties of the printed planar structure can be varied substantially. is possible, for instance, to press a paste with a low viscosity into the planar structure from the underside, to cause cementing and to thereby obtain a rigidification of the planar structure. At the same time, a highly viscous pigment can be applied to the top side, which depending on the composition is not visible on the underside of the planar structure but nevertheless brings about an intensive coloring of the top side. In both cases, it is possible to vary the embedded amounts of paste to the desired extent by varying the pressure of the pressing-in operation, using the same printing tools.

Likewise, aqueous dispersions can be printed-on, the main components of which are thermoplastics such as polyethylene co-polyamides, polyesters, polyurethanes, polyvinylacetates or ethylenevinylacetates, polyethylene-vinyl alcohols, terpene resins, hydrocarbon resins, and the like as well as any mixtures thereof. Also plastisols, such as of polyvinylchloride-polyvinylacetate copolymers, can be printed without difficulty.

The method thus allows many variations. Also, through application of the method, the mechanical properties of flexible planar structures can be varied on a large scale. A special advantage to be pointed out is the particularly high operating reliability, besides the low investment costs for the procurement of the required machinery. It is another substantial advantage that the method can be applied for printing flexible planar structures of any kind, for instance, to the printing of paper-, film- or textile webs of natural and/or synthetic materials.

In the simplest embodiment, the apparatus required for carrying out the method consists of two printing cylinders which revolve with the same circumferential velocity in opposite directions and which are arranged in parallel to each other. In addition, the axial spacing of the cylinders is adjustable, and at least one of the printing cylinders has a soft elastic surface. In principle, both printing cylinders can be taken from known methods. They are supplied with the pastes to be processed by suitable means from the outside or the inside in accordance with the known methods.

According to a particular embodiment, it is provided that both printing cylinders are arranged vertically relative to each other. In such an embodiment, the upper printing cylinder can consist of a cylindrical screen printing stencil, in which a wiper blade is arranged. The paste to be processed is placed in the interior of the screen printing stencil, and depending on the setting angle of the wiper blade to the horizontal, is pressed through the openings of the screen printing stencil in a quantity per unit area of the printed material which is adjustable. With the vertical arrangement of the two printing cylinders on top of each other, a particularly wide range of variation with respect to the setting angle of the wiper blade is obtained. The specific amounts actually printed-on can therefore be varied to a particularly large extent.

To avoid smudged print patterns which can be caused by thickness differences of the printed planar structure, it has been found advantageous if the lower printing cylinder has a jacket of soft elastic material with engraving corresponding to the desired print pattern. Through the use of such a printing cylinder, uniform pressure of the flexible planar structure against the surface of both printing cylinders is achieved. This is also the case, of course, if both printing cylinders have such a soft elastic jacket.

The hardness of the elastic jacket, which in this context is understood in particular to be spring elasticity, depends on the deformability of the printed flexible planar structures. It must be taken into consideration here that in order to obtain a neat print pattern, a certain minimum pressure is necessary, and that too much pressure can cause deformation in the planar structure, which, depending on the thickness, can influence the absorptivity differently in different zones. Also, due to this, disturbances can occur in the printed pattern. For this reason, adaption to the prevailing conditions is necessary in an individual case. An expert skilled in printing technology will not find such adaptions difficult.

The cylinder used may have to be of the letterpress type as well as the gravure engraving type. The choice is dependent in particular on the type of the planar structure to be printed.

As far as printing planar structures, from the surface of which fibers protrude, it has been found to be advantageous to use letterpress engraving. For one, a printing cylinder provided with such engraving tends to get dirty to a substantially lesser degree. Hence, a clean print pattern can be obtained after an extended period of operation. Second, the even pattern engraving which projects above the surface of the printing cylinder lies with its entire area against the surface of the planar structure to be printed. This causes the entire volume of liquid adhering to the pattern engraving to be pressed into the interior of the fiber-containing planar structure. Printing liquids can also be embedded in the interior of porous planar structures via a corresponding procedure and be distributed therein uniformly over the entire cross section in the region of the pattern engraving.

An apparatus in which the lower printing cylinder is a letterpress cylinder with a soft elastic jacket, and in which the upper printing cylinder is constructed as a screen printing stencil, is particularly well suited for applying simultaneously and continuously intermittent layers of a binder and an adhesive on opposite sides of a non-woven material for a fusible interlining. The intermittent layers have the same geometric pattern and are related to each other in mirror symmetry. They consist of a pattern of circular areas which are related to each other at a given spacing. Fabrics printed in this manner exhibit good strength, high breathing activity and good flexibility. The relative densification of the inner structure through the embedment of the binder immediately below the respective adhesive areas prevents the adhesive substance from penetrating onto the rear side of the non-woven material during its thermal softening in the fixation process.

Attention should be paid to the fact that the drying and sintering temperature of the adhesive substance can be identical with the condensation or crosslinking temperatures of the binder. For polyamide adhesives of terpolyamide laurinlactam-caprolactam-AH-salt 2:1:1, the optimum drying temperature is 120°.

The printing process used for the continuous printing of a flexible planar structure will be explained in detail in the following example.

It is possible to choose the temperature and the velocity so that the coloring matter or the melting adhesive is sufficiently dried or sintered, respectively, and the binder is, at the same time, condensed or cross-linked correctly. For an oppositely arranged binder print, for instance, an epoxy-containing dispersion is suitable, which is cross-linked cold with the addition of 1% sodium carbonate and furnishes after drying and a few days storage, a washable and chemically cleanable non-woven web material. It was found that due to the protective binder print layer, the melting adhesive cannot flow into the web, whereby heating to, say, 150° C. for the chemical cross-linking of an N-methylol-group-containing polyacrylic ester or butadiene binder is likewise possible.

The invention is further illustrated with reference to the accompanying figure and the following example.

Using a carder, a longitudinally oriented fibrous web is prepared which consists 100% of stretched polyester fibers with a titer of 1.7 dtex and a staple length of 40 millimeters (mm), and which has an area weight of 30 grams per square meter (g/m$^2$).

The web is presolidified by being passed through a calender at a speed of 30 meters per minute (m/min). The calendar has metal rollers 2 lying on the surface of the web with a diameter of 160 millimeters (mm) and a fine surface engraving of 80 mesh. The rollers are heated to a temperature of 180° C. and are set relative to each other in such a manner that a line pressure of 20 kilograms per centimeter (kg/cm) is obtained in the rolling gap (nip) between the rollers.

Immediately following the calender, i.e., at a distance of about 80 centimeters (cm), the presolidified fibrous web 1 is conducted through a printing station and is printed. To this end, the printing station includes a cylinder for printing the underside of the web and an opposed cylinder for printing the topside of the web.

The cylinder for printing the underside of the web is a letterpress cylinder 3 with a jacket of rubber 4 with a hardness of 65 Shore A. The jacket has raised portions arranged thereon with a diameter of 0.8 millimeters (mm) with a circular base area. These raised portions are arranged in the longitudinal and crosswise direction at a regular and recurring spacing of 2.4 millimeters (mm) from each other.

A binder dispersion of a 30% binder of the polyacrylate type which is densified with methyl cellulose and has a viscosity of 6,500 centipoise (cP) is applied to the letterpress cylinder from below via a steel cylinder 5, the surface of which has a fine engraving of 90 mesh, and which rests with contact or pressure against a dip roller of rubber 6. The binder dispersion used is lifted by the dip roller from a supply tank 7 and transported to the steel cylinder, the excess being squeezed off from the steel cylinder. Depending on the velocity of the steel cylinder and the contact pressure set with the dip roller, the amount of liquid transferred to the printing cylinder can be varied very finely. Based on a customary solids contents of less than 50%, the amount can be set, for instance, to a value of 5 to 7 grams per square meter ($g/m^2$), referred to the dried mass of the binder. Further variations can be obtained by changing the viscosity and/or by altering the engraving of the steel cylinder. Customary and particularly easily processed viscosities are in the order of 6,000 to 8,000 centipose (cP).

The screen printing cylinder 8 arranged vertically above the letterpress cylinder has circular openings 9 which are distributed over the cylindrical surface on a pitch which, in the lengthwise and cross-wise direction, is correlated with mirror symmetry to the respective raised portions of the letterpress cylinder. However, the diameter of these openings is somewhat smaller than that of the raised portions, e.g. by an amount of 0.5 millimeters (mm).

The screen printing and the letterpress cylinders are mechanically coupled to each other in such a manner that they have opposite and absolutely the same surface velocity. In cases when it is desired to obtain an improved impression of the liquid printed-on by the letterpress cylinder into the printed planar structure e.g. by giving the impression a larger diameter, it is necessary to insert variable-speed gearing between the cylinders in order to obtain a uniform surface velocity.

The screen printing cylinder is also provided with a wiper 10 which extends parallel to the axis of the cylinder and which rests with an edge spring-elastically against the part of the inner wall which is opposite the letterpress cylinder. The leading edge of this wiper forms a variable angle between 15° to 90° with the entering direction of the printed fabric material. The amount of liquid 11 pressed through the openings of the screen printing cylinder by the wiper per unit area of printed material increases with decreasing angle. By using the wiper and by varying the viscosity of the adhesive material dispersion, the specific amount of application can be controlled. A commonly used amount of application of 10 grams per square meter ($g/m^2$) is obtained, for instance, in the present case, using an aqueous adhesive matter dispersion on the basis of terpolyamides of laurinlactam, caprolactam AH salt in the ratio of 2:1:1 with a solids content of 40% and a viscosity of 13,000 cp and a setting angle of the wiper of 20°.

The planar structure leaving the printing station was warmed up on the underside by infrared radiators 12 in order to accomplish partial removal of excess moisture. A comparable effect can also be achieved by conducting the planar structure on one side over one or several heated cylinders. The fabric material pre-fixed there was seized by a tentering frame and dried at the same velocity at 120° by means of hot air.

The binder contained in the fabric web material was dried and condensed completely after 5 days storage. The material leaving the dryer could be used directly as a fixation insert. The material was stable in washing and chemical cleaning and showed good adhesive strength versus commercial outer materials.

The special advantages of the method according to the invention become clear by the example of the above-described preparation of fusible interlining. These advantages consist primarily in that the patterns applied to the surfaces not only can be correlated in printing the most different materials and therefore, also in fixed relation to each other, but also in that the patterns can be defined with their dimensions exactly, without mutual degradation as to their dimensions. By modifying the viscosity of the liquids applied to both surfaces, it is possible to determine their depth of penetration in dependence on each other or independently of each other. Thus a targeted influence of the internal structure as well as a targeted influence on the surface structure of porous materials is possible. This makes it possible to determine the mechanical and technological properties in a planned manner. It is a further advantage that all known printable liquids and pastes can be processed without limitation and, thus, also polymers which can readily be crosslinked through the addition of catalysts. With respect to the solidification of fabric-web materials, this feature is of great importance, because undesirable binder dislocations during the necessary drying operation can thus be prevented.

What is claimed is:

1. A method for making fusible interlinings by reinforcing non-woven porous sheets comprising printing on one surface of said sheet a cross-linkable binder and on the opposite surface of said sheet printing a thermally softenable adhesive, and solidifying said adhesive and binder, wherein the binder is printed into the one surface of said sheet by means of relief or photogravure printing and the thermally softenable adhesive is simultaneously printed onto the opposite surface of said sheet directly opposite the binder by means of a screen printing process.

2. The method of claim 1 wherein the binder and adhesive are printed in a pattern.

3. The method of claim 1 wherein the binder is printed at a different pressure than is the adhesive.

4. A method for making fusible interlinings, comprising the steps of:

preparing a porous non-woven fabric;

applying a cross-linkable binder to a first surface of said fabric by relieve or photogravure printing and simultaneously applying a thermally softenable adhesive to a second surface of said fabric in register with said binder by a screen printing process.

5. The method recited in claim 4, wherein:

the binder is a polyacrylate densified with methyl cellulose having a viscosity of 6,500 cP.

* * * * *